US005809903A

United States Patent [19]

Young, Jr.

[11] Patent Number: 5,809,903

[45] Date of Patent: Sep. 22, 1998

[54] PALLET WITH SELF-ALIGNING CONSTRUCTION

[75] Inventor: Robson T. Young, Jr., Kirkland, Ill.

[73] Assignee: National Pallet LLC, Kirkland, Ill.

[21] Appl. No.: 770,084

[22] Filed: Dec. 19, 1996

Related U.S. Application Data

[63] Continuation-in-part of Ser. No. 386,889, Feb. 10, 1995, Pat. No. 5,592,885, which is a continuation-in-part of Ser. No. 307,313, Sep. 16, 1994, Pat. No. 5,517,926.

[51] Int. Cl.[6] ..... B65D 19/00

[52] U.S. Cl. ..... 108/51.3; 108/56.3

[58] Field of Search ..... 108/51.3, 51.1, 108/56.1, 56.3

[56] References Cited

U.S. PATENT DOCUMENTS

| | | | |
|---|---|---|---|
| 2,493,562 | 1/1950 | Yarman | 108/51.3 |
| 3,026,078 | 3/1962 | Simkins . | |
| 3,434,435 | 3/1969 | Achermann et al. . | |
| 3,628,469 | 12/1971 | Neitzke . | |
| 3,911,834 | 10/1975 | Quaintance . | |
| 3,940,101 | 2/1976 | Heidelbach | 108/51.3 X |
| 3,952,672 | 4/1976 | Gordon et al. . | |
| 4,863,024 | 9/1989 | Booth . | |
| 4,927,026 | 5/1990 | Gossler et al. . | |
| 4,949,898 | 8/1990 | Nederveld . | |
| 5,176,090 | 1/1993 | Roberts et al. . | |
| 5,195,440 | 3/1993 | Gottlieb | 108/56.3 X |
| 5,222,444 | 6/1993 | Youell, Jr. et al. . | |
| 5,230,291 | 7/1993 | Juvik-Woods . | |
| 5,269,219 | 12/1993 | Juvik-Woods . | |
| 5,285,731 | 2/1994 | McIntyre . | |
| 5,327,839 | 7/1994 | Herring et al. . | |
| 5,329,861 | 7/1994 | McCarthy . | |
| 5,339,746 | 8/1994 | Vannatta . | |
| 5,377,600 | 1/1995 | Speese et al. . | |
| 5,441,154 | 8/1995 | Youell, III . | |
| 5,562,048 | 10/1996 | Gottlieb | 108/51.3 |

FOREIGN PATENT DOCUMENTS

| | | |
|---|---|---|
| 0 183 140 | 11/1985 | European Pat. Off. . |
| 0 334 329 | 9/1989 | European Pat. Off. . |
| 2.158.447 | 6/1973 | France . |
| 90 06 016.4 | 11/1991 | Germany . |
| 92 16 776.4 | 3/1993 | Germany . |

*Primary Examiner*—Peter M. Cuomo
*Assistant Examiner*—Janet M. Wilkens
*Attorney, Agent, or Firm*—DeWitt Ross & Stevens S.C.

[57] ABSTRACT

A pallet is described wherein a pallet deck is supported by collapsible tubular support members having rectangular cross-sections. The pallet has a main portion including the pallet deck and a series of flaps extending from the lateral sides of the pallet deck, these flaps being foldable to define outermost support members. The flaps are sized to fold in such a manner that the outermost support members are automatically aligned in parallel fashion, with cross-sectional configurations that guarantee collapsibility, when the flaps are folded inwardly to the greatest possible extent. The pallet also includes a central portion including a central support member and side flaps extending from the lateral sides of the central support member. The side flaps are sized and configured to align the central support member in parallel and simultaneously collapsible relation to the outermost support members when fit between and in abutment with the outermost support members.

20 Claims, 5 Drawing Sheets

FIG. 3
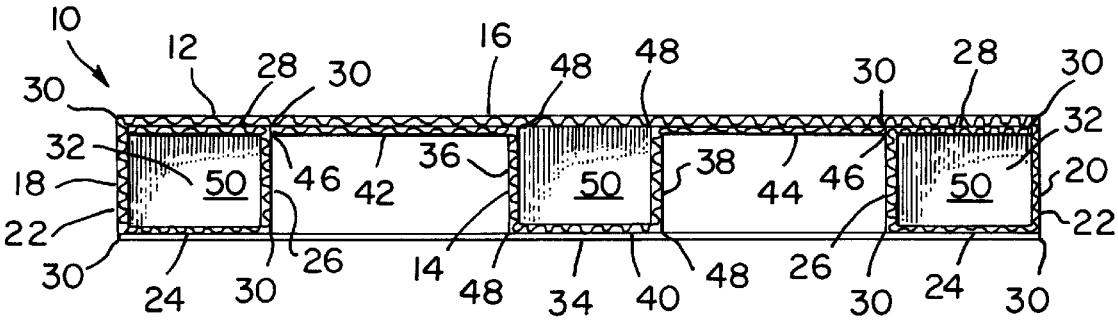
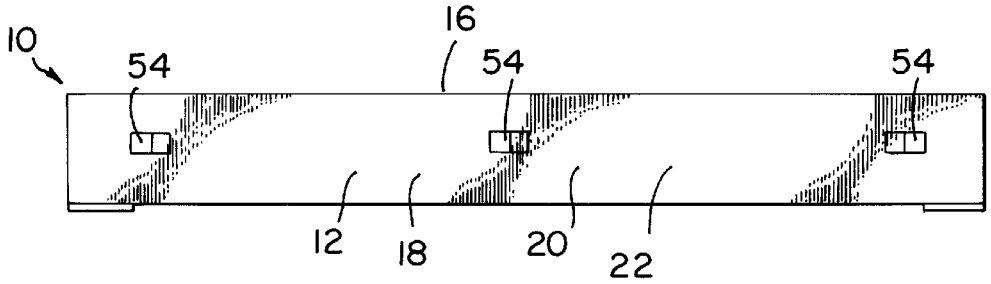
FIG. 4

14
34
38
48
40
36
42
46
44
46
48
48
58
58
58
58
58
58
30
30
30
30
30
30
30
30
50
50
50
50
50
50
50
50
54
54
54

PALLET WITH SELF-ALIGNING CONSTRUCTION

CROSS-REFERENCE TO RELATED APPLICATIONS

This is a continuation-in-part of U.S. patent application Ser. No. 08/386,889 filed 10 Feb. 1995 now issued as U.S. Pat. Ser. No. 5,592,885 (the entirety of which is incorporated by reference herein), which itself is a continuation-in-part of U.S. patent application Ser. No. 08/307,313 filed 16 Sep. 1994, now issued as U.S. Pat. Ser. No. 5,517,926 (the entirety of which is incorporated by reference herein).

FIELD OF THE INVENTION

This invention relates generally to pallets, and more specifically to pallets which may be repeatedly collapsed for easy storage and transportation and later erected at locations of use for supporting cargo.

DESCRIPTION OF THE PRIOR ART

Pallets are commonly used to support cargo. This disclosure concerns collapsible pallets which may be collapsed to flat form for storage and transport, and alternately erected to pallet form at locations of use. For example, cargo may be shipped on the pallet, and after the cargo is removed at its final location, the pallet may be collapsed so that it occupies less storage space during shipment back to its point of departure. As an exemplary collapsible pallet, consider U.S. Pat. Ser. No. 5,222,444 to Youell, Jr. et al., specifically at FIGS. 7 and 8. FIG. 7 illustrates an erect pallet having three beam-like collapsible support members having rectangular cross-sections. Two outermost support members are aligned along opposite sides of the bottom of the pallet deck and a central support member extends along the bottom of the pallet deck parallel to the outermost support members. The rectangular shape of the support members allows them to be collapsed by folding them as illustrated in FIG. 8, so that their opposing vertical sidewalls and opposing horizontal floors and ceilings are all aligned along substantially the same plane. Examples of patents which illustrate pallets designed for relatively rapid construction and disassembly and/or for collapsibility are illustrated in U.S. Pat. 3,026,078 to Simkins; U.S. Pat. No. 3,434,435 to Achermann et al; U.S. Pat. No. 3,628,469 to Neitzke; U.S. Pat. 3,952,672 to Gordon et al; U.S. Pat. No. 3,911,834 to Quaintance; U.S. Pat. No. 4,863,024 to Booth; U.S. Pat. No. 5,176,090 to Roberts et al.; U.S. Pat. No. 5,222,444 to Youell, Jr. et al.; U.S. Pat. No. 5,230,291 to Juvik-Woods; U.S. Pat. No. 5,285,731 to McIntyre; U.S. Pat. No. 5,329,861 to McCarthy; U.S. Pat. No. 5,339,746 to Vannatta; U.S. Pat. No. 5,377,600 to Speese et al.; and U.S. Pat. No. 5,441,154 to Youell, III, as well as European Patent Applications 183140 and 334329; French Patent Application 2,158,447; and German utility models (Gebrauchsmusteren) 90 06 016.4 and 92 16 776.4.

Pallets such as those of Youell, Jr. et al. must be carefully assembled if they are to be rapidly collapsible into a flat form. If a support member is not properly formed with a precisely rectangular cross-section—that is, so that its opposing vertical sidewalls are parallel, and its opposing horizontal floor and ceiling are parallel—it cannot collapse because the sidewalls and floor/ceiling will act as a truss. It is evident that a support member can only be collapsed if its vertical sidewalls and horizontal floor/ceiling are respectively parallel. In order to guarantee such an arrangement, the parts of each support member must be carefully aligned and glued together during construction, and therefore fairly time-consuming assembly steps are required if the pallet is to be repeatedly collapsible.

Similarly, failure to align all of the support members in a precisely parallel manner when they are being adhered to the pallet deck can also make it difficult to collapse the pallet. If the vertical walls of one support member (e.g., the support member 46 in FIGS. 7–8 of Youell, Jr. et al.) are not parallel with respect to the vertical walls of another support member (e.g., support member 48), these support members are incapable of being simultaneously collapsed. Thus, time and care must also be taken during assembly to ensure that the support members are parallel.

Collapsible pallets such as those of Youell, Jr. et al. must also be carefully assembled if they are to perform with maximum strength. Two types of strength are important for collapsible pallets: the load-bearing strength of the pallets, that is, their ability to withstand compression loads exerted vertically downward on the deck of the pallets, and their "side-shifting" strength, that is, their ability to withstand horizontally-oriented forces without collapsing. When assembling a collapsible pallet, there are three major considerations that must be kept in mind to maximize load-bearing and side-shifting strength.

First, assembly of collapsible pallets with misaligned parts, e.g., an improperly formed support member with non-parallel opposing walls, can cause excess wear and premature failure. This is particularly true because repeated collapsing and erection of improperly assembled pallets creates unintended fold lines which are subject to ripping under both side-shifting and compression loads, and which may also cause premature collapse. This is particularly true when side-shifting forces are present.

Second, if the sides and ends of the support members are not precisely aligned with the edges of the pallet deck, the exposure of the seams between the deck and the support members is exaggerated. This makes it easier for cargo or other objects to catch the deck and/or support members and cause one to tear from the other.

Third, failure to properly center the central support member and/or align the outermost support members along the edges of the pallet deck can also affect the pallet's durability. If the central support member is not centered, one side of the pallet will have lesser load-bearing capacity. If this side of the pallet fails, the pallet may dump its load to one side off the pallet deck.

SUMMARY OF THE INVENTION

The present invention is directed to a collapsible pallet having self-aligning construction, that is, it may be rapidly assembled with all parts automatically aligned for collapsibility with maximum durability. To enhance the reader's understanding, the following summary of the invention will make reference to the embodiments shown in the drawings, which are discussed at greater length below. As best shown in FIG. 5, the pallet includes two portions: a main portion which includes the pallet deck and the outermost support members (that is, the support members that rest beneath the pallet deck at its opposing lateral sides), and a central support portion which includes one or more central support members which rest between the outermost support members. In the main portion, the outermost support members are defined by a series of flaps extending from the lateral sides of the pallet deck. Each series of flaps includes an outer sidewall flap, a floor flap, an inner sidewall flap, and a ceiling flap. The flaps are separated by fold lines, all of which are parallel. The flaps may be folded beneath the pallet deck so that the ceiling flap is in abutment with the underside of the pallet deck, thereby placing the inner and outer sidewall flaps in opposing relation and also placing the ceiling and floor flaps in opposing relation (FIGS. 1–3 ). This defines an internal channel within each outermost support member. The width of the floor and ceiling flaps is approximately the same, and additionally the height of the outer and inner sidewall flaps is approximately the same (both of these dimensions being measured laterally from the pallet deck).

As a result of the aforementioned arrangement, the main portion can be exceptionally rapidly assembled to provide a pallet deck wherein the outermost support members will automatically be parallel and simultaneously collapsible when the ceiling flap is folded into abutment with the outer sidewall flap and the pallet deck (see particularly FIG. 3). Provided the ceiling flap is placed in abutment with the outer sidewall flap, there is no possibility of forming outermost support members which are uncollapsible owing to non-parallel outer and inner sidewall flaps, and/or non-parallel ceiling and floor flaps. Furthermore, provided all fold lines are parallel, there is no possibility of assembling the main portion so that the outermost support members are not parallel and simultaneously collapsible. Because this is all accomplished by placing the ceiling flaps in abutment with the outer sidewall flaps—which is the easiest mode of constructing the outermost support members—the main portion is said to be self-aligning because it virtually requires conscious effort to make outermost support members which are not parallel and simultaneously collapsible. Additionally, there is no exposed seam between the outermost support members and the pallet deck at the lateral edges of the pallet whereupon cargo can catch and tear the pallet deck, and the longitudinal ends of the outermost support members are automatically aligned with the ends of the pallet deck.

The central support portion (see particularly FIG. 5) includes at least one central support member having opposing sidewalls with a floor therebetween, and side flaps extending from the sidewalls and terminating in lateral edges. The floor, sidewalls, and side flaps are all separated by fold lines, which are parallel to each other and additionally to the lateral edges of the side flaps. The sidewalls are sized to have the same height, and the side flaps are sized so that when they are placed in parallel relation to the floor at maximum distance therefrom, their lateral edges fit in abutment with the inner sidewalls of the outermost support members when inserted therebetween. As a result, when the central support portion is placed in an operating position wherein the side flaps are in abutment with the inner sidewalls of the outermost support members, the sidewalls of the central support member are placed in parallel opposing relation and the fold lines of the central support member are parallel to the fold lines of the outermost support members. In other words, all support members are made parallel and simultaneously collapsible. Because this is accomplished by merely placing the side flaps in abutment with the inner sidewalls of the outermost support members, the central support portion is said to be self-aligning because it requires virtually no effort to make a central support member which is parallel and simultaneously collapsible with the outermost support members.

The self-aligning pallet as described above may incorporate additional features to increase its load-bearing capacity. A description of several such features follows.

First, one or both of the outermost support members may include a support flap which is defined on the floor, the sidewalls, or the ceiling of the outermost support member, and which is adapted to fold into the internal channel of that support member to abut the opposing ceiling, sidewall, or floor. The folding of the support flap into the internal channel defines a support compartment in the outermost support member, the support compartment opening onto the floor, sidewall, or ceiling upon which the support flap is defined. In preferred embodiments of the invention, these support flaps are provided in pairs wherein the support flaps are adjacent each other so that folding of the support flaps into the internal channel defines support compartments between the respective support flaps within each pair. A support flap may include a locking tongue extending from its edge, and the opposing ceiling, sidewall, or floor which the support flap abuts may include a receiving opening therein to receive the locking tongue and thereby maintain the support flap within the internal channel. Support flaps such as those described above may be included on the central support member of the central support portion as well.

Second, support blocks may be provided which are sized to fit within the aforementioned support compartments, thereby providing additional support structure within the internal channels of the support members. While support blocks per se are known to the art, this disclosure illustrates new forms of support blocks which are easily and rapidly constructed, which may be unfolded into a flat form for easier transportation and storage, and which impart surprisingly superior strength to collapsible pallets. A first embodiment of such a support block is illustrated in FIG. 2, and a second particularly preferred embodiment is illustrated in FIG. 2 and additionally in FIGS. 6–9. In the case of the first embodiment, the support block is formed of a flat strip including a series of contiguous segments. The strip is rolled in spiral fashion so that its segments overlap, thereby adopting a tubular configuration which snugly fits into the support compartment (e.g., into a rectangular tube in the case where the support compartment has a rectangular configuration). The axis of the tube is oriented generally perpendicular to the deck of the pallet. In the second embodiment of the support block (i.e., the embodiment of FIG. 2 and FIGS. 6–9), the support block is formed of a strip which is cut along a major portion of an axis situated along the length of the strip to thereby define two strip portions joined at a common portion. The common portion is folded about the axis to abut itself in overlapping fashion to form a double layer of strip material. Each strip portion can then be repeatedly folded along its length into several segments, some of which may overlap. These segments are preferably folded in spiral overlapping fashion (FIGS. 8 and 9) so that each strip portion adopts a generally tubular configuration adapted to closely fit within the support compartment; again, in the case of a rectangular support compartment, each strip portion is rolled into a generally rectangular tube. Preferably, the common portion is located at a position on the support block such that it is aligned along a plane perpendicular to the length of the support member when the support block is inserted within the support compartment. Additionally, multiple overlapping segments are preferably provided at planes parallel to the common portion and perpendicular to the length of the support members. As a result of the use of the various features described above, these support blocks can as much as double both the load-bearing and side-shifting strength of a pallet. It is believed that the features of the tubular (FIG. 2) or double-tube (FIGS. 2 and 6–9) configuration for the support blocks imparts superior strength in two ways: first, the use of multiple segments perpendicular to the length of the support member particularly enhances the side-shifting strength of the pallet, particularly where the segments overlap to effectively form a double-ply layer perpendicular to the support member, and second, the tubular configuration of the strip (or of each strip portion) particularly enhances the load-bearing capacity of the pallet. The support blocks can rapidly be unfolded into flat form (as in FIG. 6) for easy storage and transport.

Third, locking tabs may be provided on the support members (e.g., on at least one of the ceiling, the floor, or one sidewall of the outermost support members) adjacent the support compartments, these locking tabs being adapted to fold into the support compartments to engage support blocks and maintain them within the support compartments.

Another significant advantage of the pallets described herein is that the pallet deck effectively has a double-layer construction over the majority of its surface (save for the area above any central support members), thereby imparting greater effective strength to the pallet deck.

Further advantages, features, and objects of the invention will be apparent from the following detailed description of the invention in conjunction with the associated drawings.

BRIEF DESCRIPTION OF THE DRAWINGS

FIG. 3 is a side elevation view of the pallet of FIG. 1.

FIG. 4 is a side elevation view of the pallet of FIG. 1.

DETAILED DESCRIPTION OF THE INVENTION

Figure 5:
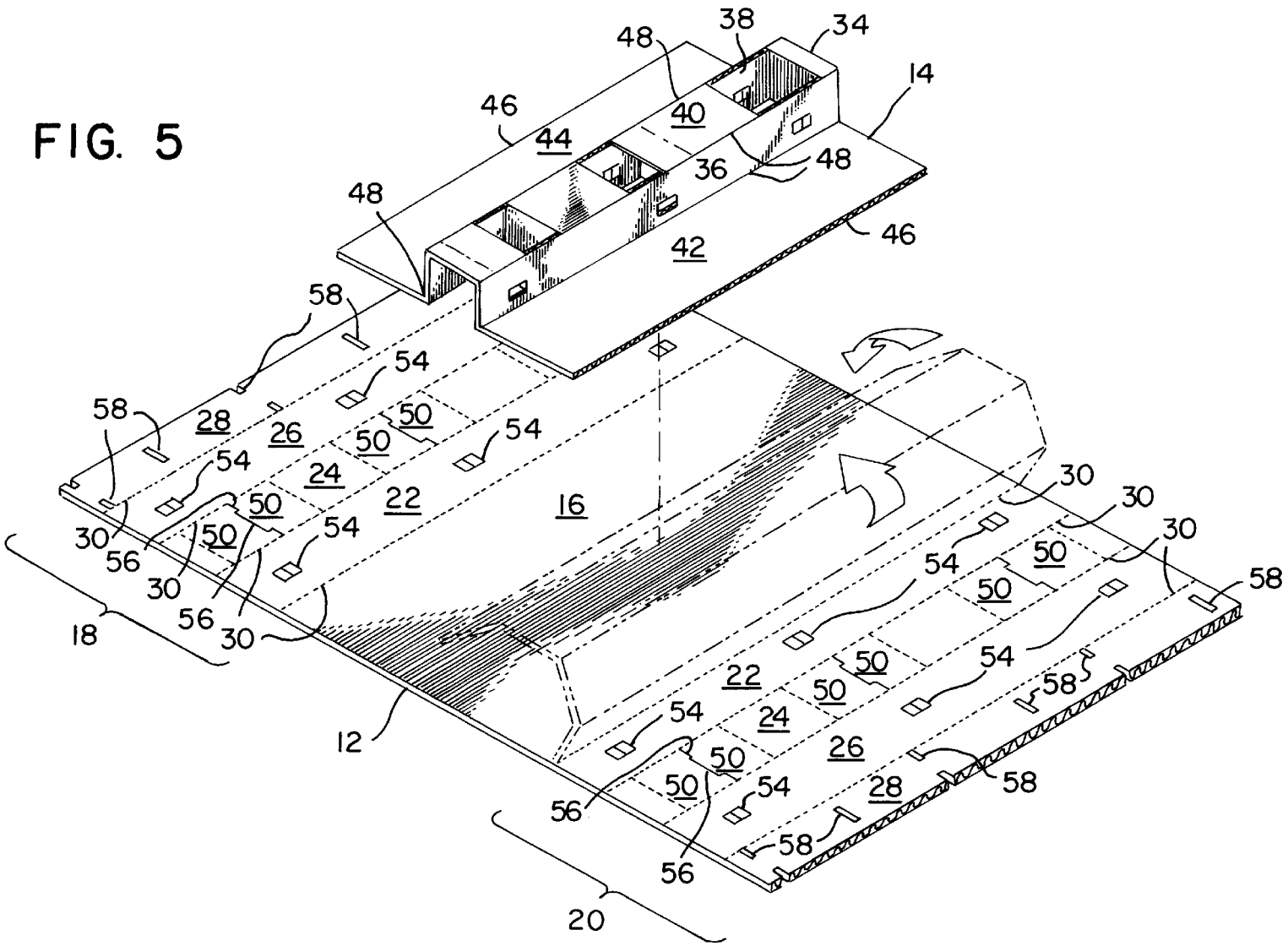
FIG. 5 is a bottom exploded perspective view of the pallet of FIG. 1 shown with the main portion of the pallet in its disassembled form (i.e., as a blank), and illustrating the central support portion in assembled form.

In the drawings, wherein the same or similar features of the invention are designated in all Figures with the same reference numerals, the primary embodiment of the pallet of the present invention is illustrated in assembled form in FIGS. 1–4 at 10. As is best shown by FIG. 5, which illustrates the pallet 10 in disassembled form, the pallet 10 includes two main portions: a main portion 12 and a central support portion 14. Each of these portions 12 and 14 will now be discussed in turn.

The main portion 12 includes a pallet deck 16 and two outermost support members 18 and 20, each resting beneath the pallet deck 16 at its opposing lateral sides. As best shown by FIG. 5, wherein the main position 12 is illustrated in unassembled (i.e., blank) form, the outermost support members 18 and 20 are defined by a series of flaps extending from the lateral sides of the pallet deck 16. These flaps include an outer side wall flap 22; a floor flap 24; an inner side wall flap 26; and a ceiling flap 28. The flaps 22, 24, 26, and 28 are separated from each other (and from the pallet deck 16) by fold lines 30.

It is intended that the flaps 22, 24, 26, and 28 be folded inwardly along the fold lines 30 to define generally tubular outermost support members 18 and 20 having internal channels 32 therein, thereby converting the blank main portion 12 (FIG. 5) to the assembled main portion 12 illustrated in FIGS. 1–4. However, in order to make the main portion 12 self-aligning—that is, to automatically make the outermost support members 18 and 20 parallel, with their respective inner/outer side walls 22/26 and floor/ceiling 24/28 aligned in parallel relation so that both of the outermost support members 18 and 20 are simultaneously collapsible—the flaps 22, 24, 26, and 28 that form the outermost support members 18 and 20 must meet certain specifications.

First, all fold lines 30 must be parallel. This guarantees that the outermost support members 18 and 20 will be parallel when the flaps 22, 24, 26, and 28 are folded along the fold lines 30.

Second, the outer and inner side wall flaps 22 and 26 must be formed with approximately the same height (as measured laterally from the pallet deck 16 in FIG. 5), and the floor and ceiling flaps 24 and 28 must be formed with approximately the same width (also as measured laterally from the pallet deck 16 in FIG. 5). Ideally, to be exact, the inner side wall flap 26 should be formed slightly shorter than the outer side wall flap 22, and the ceiling flap 28 should be slightly shorter than the floor flap 24, by a distance equal to the thickness of the material used to construct the main portion 12. This more precise sizing makes the outer/inner side wall flaps 22/26, as well as the floor/ceiling flaps 24 and 28, more precisely aligned in parallel relation. While this degree of precision may not seem significant, it can contribute significantly to the strength and lifetime of the pallet 10.

By forming the outermost support members 18 with dimensions that fairly precisely meet these specifications, the inner/outer side walls 22/26 and floor/ceiling 24/28 will automatically be aligned in parallel relation when the face of the ceiling flap 28 is folded into abutment with the pallet deck 16, with its outermost lateral edge in abutment with the outer side wall flap 22. This ensures that the outermost support members 18 and 20 are easily and simultaneously collapsed when the pallet is pushed in a lateral direction, and when no objects rest within the internal channels 32 of the outermost support members 18 and 20. Additionally, the one assembling the main portion 12 does not need to pay particularly close attention to the alignment of the flaps 22, 24, and 26 during assembly because it is an easy matter to place the ceiling flap 28 in abutment with both the pallet deck 16 and the outer side wall 22. Naturally, adhesive may be used to affix the ceiling flap 28 to the pallet deck 16 and/or the outer side wall 22 if permanency is desired.

The central support portion 14 includes a central support member 34 having opposing side walls 36 and 38 with a floor 40 therebetween, and side flaps 42 and 44 extending from the lateral edges of the side walls 36 and 38 and terminating in lateral edges 46. The side walls 36 and 38, the floor 40, and the side flaps 42 and 44 are all separated by fold lines 48 (best shown in FIG. 5), which are al parallel with respect to each other and also parallel to the lateral edges 46.

It is desirable to make the central support portion 14 rapidly installable between the outermost support members 18 and 20 of the main portion 12, with the central support member 34 being parallel to (and thus simultaneously collapsible with) the outermost support members 18 and 20. This is done by sizing the side walls 36 and 38 so that they have the same height, and by also sizing the floor 40 and side flaps 42 and 44 such that when they are all placed in parallel relation with the floor 40 at maximum distance from the side flaps 42/44 when the lateral edges 46 of the side flaps 42 and 44 are fit in abutment with the inner walls 26 of the outermost support members 18 and 20. Thus, when the assembler applies adhesive to the side flaps 42 and 44 and then inserts them between the outermost support members 18 and 20 and in abutment with the pallet deck 16, the central support member 34 will automatically be formed wherein the side walls 36 and 38 are in parallel relation, and wherein the central support member 34 is parallel and simultaneously collapsible with the outermost support members 18 and 20.

From the aforementioned arrangement of the main portion 12 and central support portion 14, it will be understood that the pallet 10 can be constructed in exceptionally rapid fashion without fear of misalignment, that is, non-parallel support members, support members which are not simultaneously collapsible, or support members which have lateral or longitudinal edges which are not aligned with the edges of the pallet deck 16. This self-aligning feature simultaneously reduces both the time needed to construct the pallet, and the possibility that a misaligned (and thus less durable) pallet will be constructed.

The pallet 10 may include additional features such as support flaps 50, support blocks 52 (FIG. 2), and locking tabs 54, all of which are discussed in greater detail in U.S. Pat. No. 5,517,926 and U.S. patent application Ser. No. 08/386,889, from which this application claims priority. To briefly describe these features, the support flaps 50, which are situated on one or more of the walls of the support members 18, 20, and 34, may be folded into the internal channel 32 of the support member to maintain its walls in opposing relation. To prevent the support flaps 50 from accidentally folding out of the internal channel 32, they may include locking tongues 56 at their edges which engage receiving apertures 58 in the opposing wall. When the support flaps 50 are folded into the internal channel 32, they form support compartments within the internal channel 32 wherein support blocks 52 may be inserted. As illustrated in the Figures, the support flaps 50 are preferably formed in opposing pairs so that support compartments 60 are formed between adjacent support flaps 50 when the support flaps 50 are folded into the internal channel 32. Folding locking tabs 34 may then be formed on the walls of the support members 18, 20, and 34 adjacent the support compartments 60, and these locking tabs 54 may be folded into the support compartments 60 to engage any support blocks 52 therein and prevent them from falling out of the support compartment 60.

Figure 1:
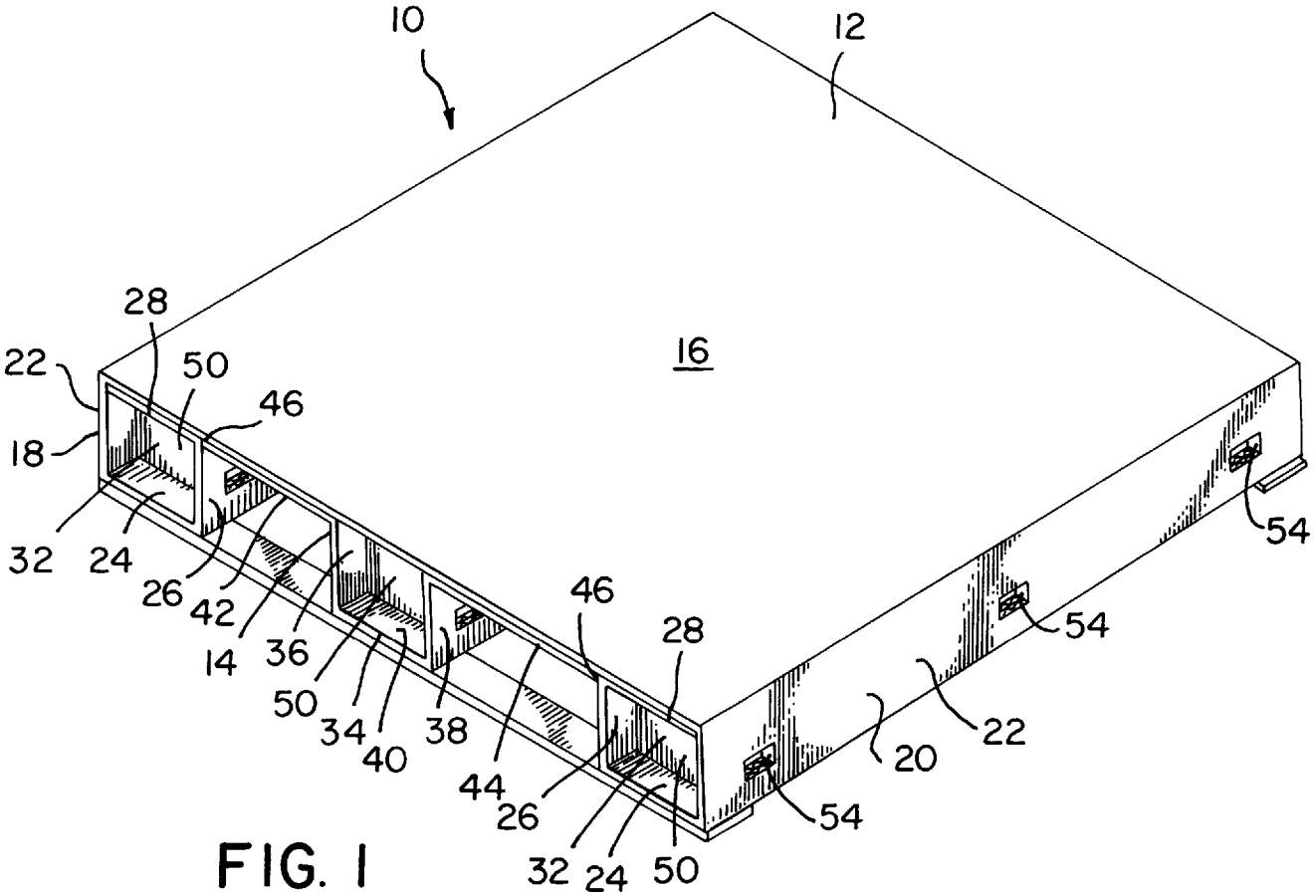
FIG. 1 is a perspective view of the pallet of the present invention.
Figure 2:
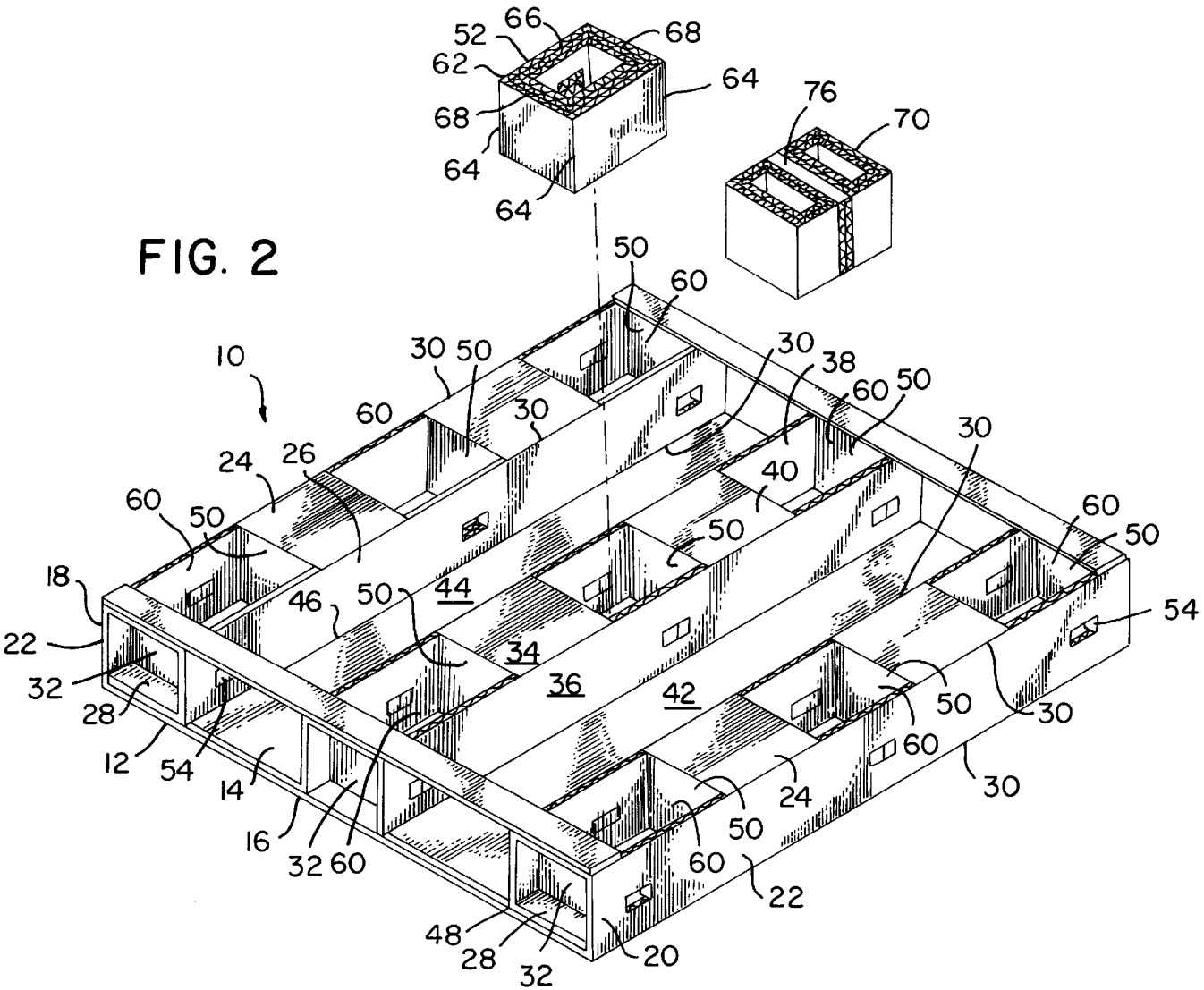
FIG. 2 is a bottom perspective view of the pallet of FIG. 1, shown with two alternate support blocks suitable for use in the pallet.

A first preferred form of support block is illustrated at 52 in FIG. 2. Advantageously, the support block 52 is formed of a strip of material 62 having a plurality of fold lines 64 which divide the strip 62 into a plurality of segments 66. The segments 66 of the strip 62 are rapidly and easily folded in spiral overlapping fashion to form the rectangular tubular configuration of the support block 52 illustrated in FIG. 2, wherein the support block 52 is snugly received within a support compartment 60. The configuration of the support block 52 has been found to impart surprisingly high strength to pallets such as the pallet 10, presumably for three reasons. First, multiple segments 66 are aligned perpendicular to the lengths of the support members 18/20/34, thereby maintaining their sidewalls 22/26 and 36/38 in spaced relation to resist side-shifting forces. Second, the use of multiple abutting/overlapping segments 66 perpendicular to the lengths of the support members 18/20/34—illustrated in FIG. 2 as segments 68—is believed to substantially amplify the resistance to side-shifting forces because these segments 66 have the strength of two-ply strips. In other words, by placing the faces of these segments 66 in abutment to form an effective multiple-ply segment 68, the segments 66 are believed to have greater strength than the sum of the strengths of two segments 66 which are parallel but spaced apart (i.e., with faces that are not in abutment). Third, the rectangular tubular configuration of the support blocks 52 is believed to provide the pallet 10 with substantially increased resistance to direct vertical loads owing to the orientation of the planes of multiple segments 66 perpendicular to the pallet deck 16.

Figure 6:
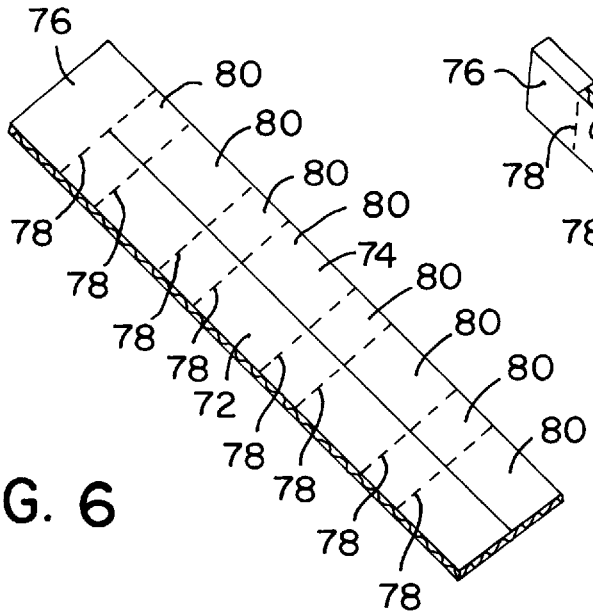
FIGS. 6–9 illustrate perspective views of a preferred support block at various stages of assembly, with FIG. 6 illustrating the support block in unassembled form (i.e., as a blank) and FIG. 9 illustrating the assembled support block.
Figure 7:
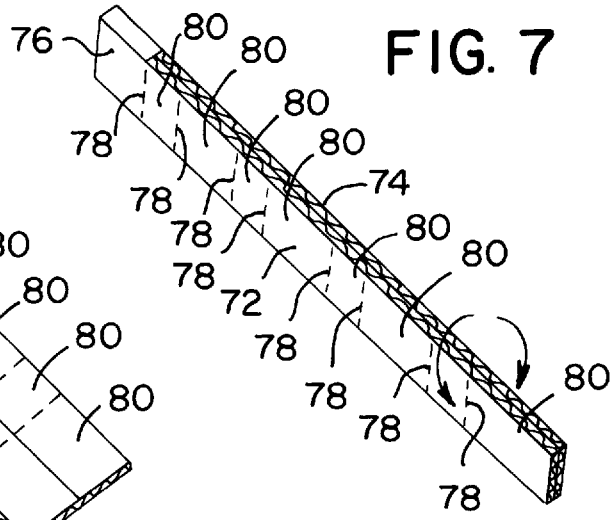
Figure 8:
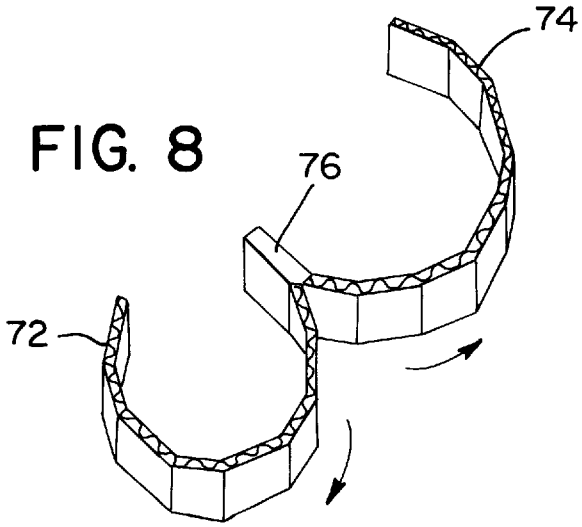
Figure 9:
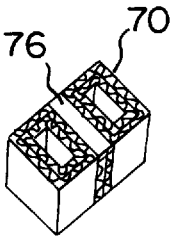

A second and particularly preferred form of support block contemplated for use in the pallet 10 is illustrated in assembled form at 70 in FIGS. 2 and 9, and in unassembled form in FIGS. 6–8. As illustrated in FIG. 6, the support block 70 may be formed of a strip having a longitudinally-oriented axis. The strip is cut along a major portion of this axis to thereby define two strip portions 72 and 74 which are joined at a common portion 76. As illustrated in FIG. 7, this common portion 76 is folded so that the common portion 76 abuts itself in overlapping fashion to form a double-ply strip. The strip portions 72 and 74 bear a number of fold lines 78 thereon which divide the strip portions 72 and 74 into numerous segments 80. Starting at the segment 80 most distant from the common portion 76, the segments are folded outwardly at fold lines 78 to adopt a spiral overlapping configuration. As a result, the support block 70 takes the form of two connecting and abutting rectangular tubular members. The final result is illustrated in FIGS. 2 and 9. As shown in those Figures, the support block 70 is preferably configured such that its common portion 76 is aligned at a plane perpendicular to the lengths of the support members 18/20/34 when the support block 70 is inserted therein. The resulting support block 70 thereby imparts strength to the pallet 10 in two ways: the plural segments 80 aligned perpendicular to the lengths of the support members 18/20/34 help to prevent collapse of the support members owing to side-shifting forces, and at the same time the dual rectangular tubes formed by the support block 70 help to support greater vertical loads exerted on the pallet deck 16. If desired, apertures can be cut in the support block 70 to accommodate locking tabs 54, as with the support block 52 illustrated in FIG. 2.

It is understood that preferred embodiments of the invention have been described above in order to illustrate how to make and use the invention. The invention is not intended to be limited to these embodiments, and is intended to encompass all alternate embodiments that fall literally or equivalently within the scope of the claims set out below. It is understood that in these claims, means plus function clauses are intended to encompass the structures described above as performing their recited function, and also both structural equivalents and equivalent structures. As an example, though a nail and a screw may not be structural equivalents insofar as a nail employs a cylindrical surface to secure parts together whereas a screw employs a helical surface, in the context of fastening parts, a nail and a screw are equivalent structures.

I claim:

1. A pallet comprising:

a. a main portion including elongated opposing generally parallel outermost support members and a pallet deck therebetween, the outermost support members being defined by a series of at least four contiguous flaps extending from opposing sides of the pallet deck, the flaps being separated by parallel fold lines, the flaps including an outer sidewall connected to the pallet deck, a floor, an inner sidewall, and a ceiling, whereby each outermost support member is formed by folding the ceiling portion into abutment with both the pallet deck and the outer sidewall, thereby placing the outer sidewall in parallel relation to the inner sidewall, placing the floor in parallel relation to the ceiling, and defining an outer internal channel within each outermost support member when its outer sidewall is spaced at maximum distance from its inner sidewall;

b. a self-aligning central support portion including a central support member and opposing side flaps extending therefrom, the central support member including opposing sidewalls and a floor therebetween, the side flaps extending from the sidewalls and being sized to fit in an operating position between and in abutment with the inner sidewalls of the outermost support members, thereby placing the sidewalls of the support member in parallel relations and also defining a central internal channel between the sidewalls of the central support member when the floor of the central support member is in parallel relation with the pallet deck and is spaced at maximum distance therefrom; and c. a support block sized to snugly fit within the internal channel of at least one of the support members.

2. The pallet of claim 1 wherein the support block is formed of at least one strip of foldable material having opposing elongated faces, the strip being folded repeatedly along its length in spiral overlapping fashion to adopt a generally tubular configuration adapted to fit within one internal channel.

3. The pallet of claim 1 wherein the support block is formed of a strip of foldable material having opposing elongated faces, the strip being cut along a major portion of an axis extending along the length of the strip to thereby define two strip portions joined at a common portion, the common portion being folded about the axis to abut itself in overlapping fashion, and each strip portion being folded repeatedly along its length.

4. The pallet of claim 3 wherein the support block is configured to align the common portion at a plane generally perpendicular to the length of the outermost support members when the support block is inserted therein.

5. The pallet of claim 4 wherein at least one of the strip portions is folded along its length into several segments, the segments overlapping in spiral fashion.

6. The pallet of claim 5 wherein at least one of the folded strip portions includes at least two segments oriented generally parallel to the common portion.

7. The pallet of claim 1 wherein at least one of the outermost support members includes at least one support flap thereon;

wherein the support flap is defined on one of the ceiling, the floor, or one sidewall of the outermost support member, and further wherein the support flap is adapted to fold into the outermost support member to engage the floor, ceiling, or sidewall opposite the support flap, whereby the folding of the support flap into the outermost support member defines a support compartment in the outermost support member, the support compartment opening onto the ceiling, floor, or sidewall upon which the support flap is defined.

8. The pallet of claim 7 wherein at least one of the outermost support members includes at least one pair of support flaps thereon, the support flaps being located adjacent each other whereby the support compartment is defined between the support flaps when the support flaps are folded into the outermost support member.

9. The pallet of claim 7 wherein the support flap includes an edge having a locking tongue thereon, and wherein the ceiling, floor, or sidewall engaged by the support flap includes a receiving opening therein for receiving the locking tongue.

10. The pallet of claim 7 wherein at least one of the outermost support members includes at least one foldable locking tab defined on at least one of the ceiling, the floor, or one sidewall of the outermost support member, each locking tab being located adjacent the support flap and thereby being foldable into the support compartment.

11. The pallet of claim 10 wherein the support block is formed of at least one strip of foldable material having opposing elongated faces, the strip being folded repeatedly along its length in spiral overlapping fashion to adopt a generally tubular configuration adapted to fit within the support compartment.

12. The pallet of claim 10 wherein the support block is formed of at least one strip of foldable material having opposing elongated faces, the strip being cut along a major portion of an axis situated along the length of the strip to thereby define two strip portions joined at a common portion, the common portion being folded about the axis to place the common portion in abutment with itself, and each strip portion being folded repeatedly along its length.

13. The pallet of claim 12 wherein the support block is configured to align the common portion at a plane generally perpendicular to the length of the outermost support member when the support block is inserted therein.

14. The pallet of claim 13 wherein at least one of the strip portions is folded into several segments, the segments overlapping in spiral fashion.

15. The pallet of claim 14 wherein each of the folded strip portions includes at least two segments oriented generally parallel to the common portion.

16. A pallet comprising:

a. A self-aligning main portion including a pallet deck and opposing generally parallel outermost support members, the outermost support members being defined by a series of at least four flaps extending laterally from opposing sides of the pallet desk, the flaps including an outer sidewall connected to the pallet deck, a floor, an inner sidewall, and a ceiling, whereby each outermost support member is formed by folding the ceiling into abutment with both the pallet deck and the outer sidewall, thereby placing the inner sidewalls of the outermost support members in parallel relation and defining an internal channel between each outermost support member's inner and outer sidewalls, and also placing the floor portion of each outermost support member in parallel relation to its respective ceiling portion;

b. a self-aligning central support portion including a central support member and opposing side flaps extending therefrom, the central support member including opposing sidewalls and a floor therebetween, the side flaps extending from the sidewalls and being sized to fit in an operating position between and in abutment with the inner sidewalls of the outermost support members, thereby placing the sidewalls of the support member in parallel relation, and also defining a central internal channel between the sidewalls of the central support member when the floor of the central support member is in parallel relation with the pallet deck and is spaced at maximum distance therefrom; and c. A support block sized to snugly fit within the internal channel of at least one of the outermost support members, the support block being formed of at least one strip of foldable material having opposing elongated faces, the strip being folded repeatedly along its length in spiral overlapping fashion to adopt a generally tubular configuration adapted to fit within the internal channel.

17. The pallet of claim 16 wherein the strip of the support block is cut along a major portion of an axis situated along the length of the strip to thereby define two strip portions joined at a common portion, and the common portion is folded about the axis to place the common portion in abutment with itself.

18. A support block in combination with a pallet having at least one elongated support member for supporting a pallet deck, wherein the support member has an internal channel therein, the support block comprising:

an elongated strip of foldable material, the strip being cut along a major portion of an axis extending along the length of the strip to thereby define two strip portions joined at a common portion, the common portion being folded about the axis to abut itself in overlapping fashion, and each strip portion being folded repeatedly along its length into a configuration sized to snugly fit within the internal channel.

19. The support block of claim 18 wherein the strip portions are folded into a configuration wherein the common portion is oriented perpendicular to the length of the support member when the support block is fit within the internal channel.

20. The support block of claim 18 wherein at least one of the strip portions is folded repeatedly along its length in spiral overlapping fashion to adopt a generally tubular configuration adapted to fit within one internal channel.

* * * * *